US007541892B2

(12) United States Patent
Gorostegui

(10) Patent No.: US 7,541,892 B2
(45) Date of Patent: Jun. 2, 2009

(54) THREE-WAY SPLITTER INCLUDING A PRINTED ELEMENT

(75) Inventor: Jose Ignacio Gorostegui, Laguna Beach, CA (US)

(73) Assignee: Broadcom Corporation, Irvine, CA (US)

( * ) Notice: Subject to any disclaimer, the term of this patent is extended or adjusted under 35 U.S.C. 154(b) by 102 days.

(21) Appl. No.: 11/716,324

(22) Filed: Mar. 9, 2007

(65) Prior Publication Data

US 2008/0218294 A1 Sep. 11, 2008

(51) Int. Cl.
*H01P 3/08* (2006.01)
*H01P 5/12* (2006.01)

(52) U.S. Cl. ..... 333/128; 333/127; 333/125; 333/134

(58) Field of Classification Search ..... 333/124–128, 333/134; 385/48
See application file for complete search history.

(56) References Cited

U.S. PATENT DOCUMENTS 4,556,856 A * 12/1985 Presser ..... 333/124
5,021,755 A * 6/1991 Gustafson ..... 333/128
5,079,527 A * 1/1992 Goldfarb ..... 333/127
6,037,845 A * 3/2000 Parker ..... 333/128
6,078,227 A * 6/2000 Buer et al. ..... 333/117

* cited by examiner

*Primary Examiner*—Robert Pascal
*Assistant Examiner*—Kimberly E Glenn
(74) *Attorney, Agent, or Firm*—Farjami & Farjami LLP

(57) ABSTRACT

According to one exemplary embodiment, a three-way splitter includes a printed element and a resistive network comprising discrete resistors. A first printed branch, second printed branch, and third printed branch distribute a received communication signal to respective outputs having substantially the same phase, frequency, and impedance. Each printed branch includes a number of substantially ninety-degree angles. In one embodiment, the printed branches are quarter wavelength transmission lines in a frequency range of 1.5 GHz. In one embodiment, the three-way splitter consumes less than one square inch of surface area on a printed circuit board, and can be used in a satellite receiving system, for example. In this embodiment, the three-way splitter is utilized for frequencies in the range of approximately 900 MHz to 2.2 GHz.

18 Claims, 5 Drawing Sheets

THREE-WAY SPLITTER INCLUDING A PRINTED ELEMENT

BACKGROUND OF THE INVENTION

1. Field of the Invention

The present invention is generally in the field of electronic communications circuits and systems. More specifically, the present invention is in the field of signal splitters.

2. Background Art

Signal splitters are typically used in satellite receiving systems to distribute an input signal to multiple outputs having substantially the same phase, frequency, and impedance, and to do so across a range of frequencies. Satellite receiving systems typically utilize a down-converter and a local oscillator to mix a high frequency reception signal down to an intermediate frequency signal, which is then typically amplified by a low noise amplifier. A three-way signal splitter ("three-way splitter") may receive the amplified signal as an input, and distribute that signal as three substantially equivalent outputs, for filtering, additional amplification, and/or tuning.

Conventionally, use of a three-way splitter introduces some loss of the input signal. Losses may be in the forms of insertion loss as well as return loss. Signal transmission may be optimized where insertion loss is minimized and reduction of the return signal is maximized. Conventional techniques for implementing a three-way splitter in a satellite receiving system typically involve the assembly of discrete components, often on a printed circuit board. These approaches share common disadvantages of expense, over-consumption of circuit board area, a too narrow frequency range over which insertion losses remain constant (or "flat").

Conventional techniques for implementing a three-way splitter in a satellite receiving system may be expensive because conventional three-way splitters are assembled from discrete components, each of which adds its own cost, and assembly and interconnection of discrete components requires a large surface area. With respect to signal input loss, typical conventional three-way splitters for satellite receiving systems may produce insertion losses of approximately 6 dB or more. Techniques intended to improve insertion loss in conventional three-way splitters often have the unfortunate consequence of exacerbating return loss, while improvements in return loss often result in a similar deterioration in insertion loss performance.

Thus, there is a need in the art for a splitter which is inexpensive, consumes less circuit board area, and provides improved insertion losses while also achieving improvement in return loss.

SUMMARY OF THE INVENTION

A three-way splitter including a printed element, substantially as shown in and/or described in connection with at least one of the figures, and as set forth more completely in the claims.

DETAILED DESCRIPTION OF THE INVENTION

The present invention is directed to a three-way splitter including a printed element. Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely exemplary embodiments of the invention. To maintain brevity, other embodiments of the invention, which use the principles of the present invention are not specifically described in the present application and are not specifically illustrated by the present drawings.

Figure 1:
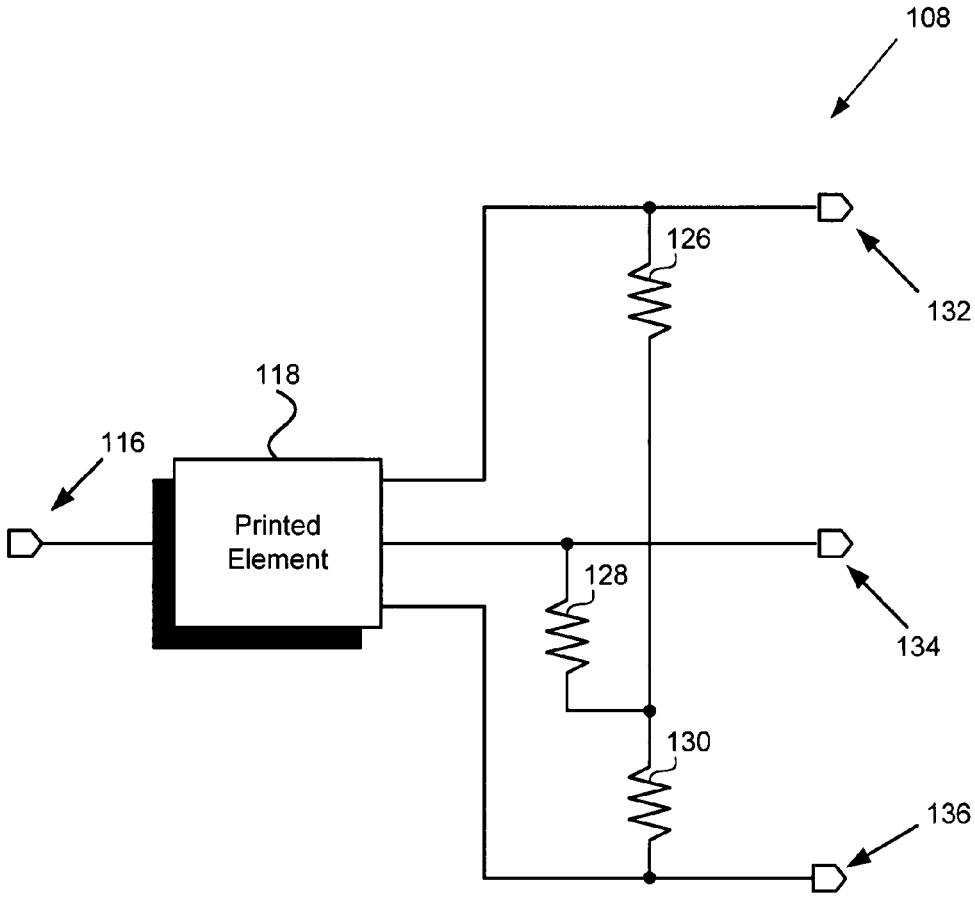
FIG. 1 is a conceptual block diagram of one embodiment of the present invention.

FIG. 1 is a conceptual block diagram of one embodiment of the present invention. FIG. 1 is for the purpose of providing an overview, and elements shown in FIG. 1 are conceptual representation of physical and electrical elements, and are thus not intended to show dimensions or relative sizes or scale. Three-way splitter 108 comprises printed element 118 having input 116 and three printed branches (not shown in FIG. 1) on a printed circuit board (not shown in FIG. 1). Three-way splitter 108 also comprises three splitter outputs 132, 134, and 136 that are inter-coupled by a resistive network comprising discrete resistors 126, 128, and 130. Discrete resistors 126, 128, and 130 can be utilized in three-way splitter 108 to, for example, aid in equalizing and matching output impedances at splitter outputs 132, 134, and 136 to the impedance at input 116. Printed element 118, including its three printed branches, can reside on a printed circuit board (PCB) that can be, for example, part of a satellite set top box. In part, through the innovative design of the three printed branches (not shown in FIG. 1), the present invention results in three splitter outputs 132, 134, and 136 having substantially the same output frequencies, phases and impedances in a manner discussed in more detail below.

By way of background, conventional techniques for implementing a three-way splitter involve only discrete components. This discrete implementation of three-way splitters introduces several practical and performance related limitations on their usefulness. From a practical standpoint, implementing a three-way splitter by assembling discrete components incurs the costs associated with procurement of the individual components, and the cost associated with their implementation, such as assembly and placement on a PCB, for example. In addition to costs, another practical concern raised by discrete implementation of a three-way splitter on a PCB, is over-consumption of PCB surface area due to a layout requiring interconnection of several separate components. The present invention resolves the practical shortcomings associated with conventional techniques, by providing a three-way splitter suitable for use on a PCB, which is substantially without extra cost to a manufacturer and less consumptive of PCB surface due to its integrated implementation.

Figure 2:
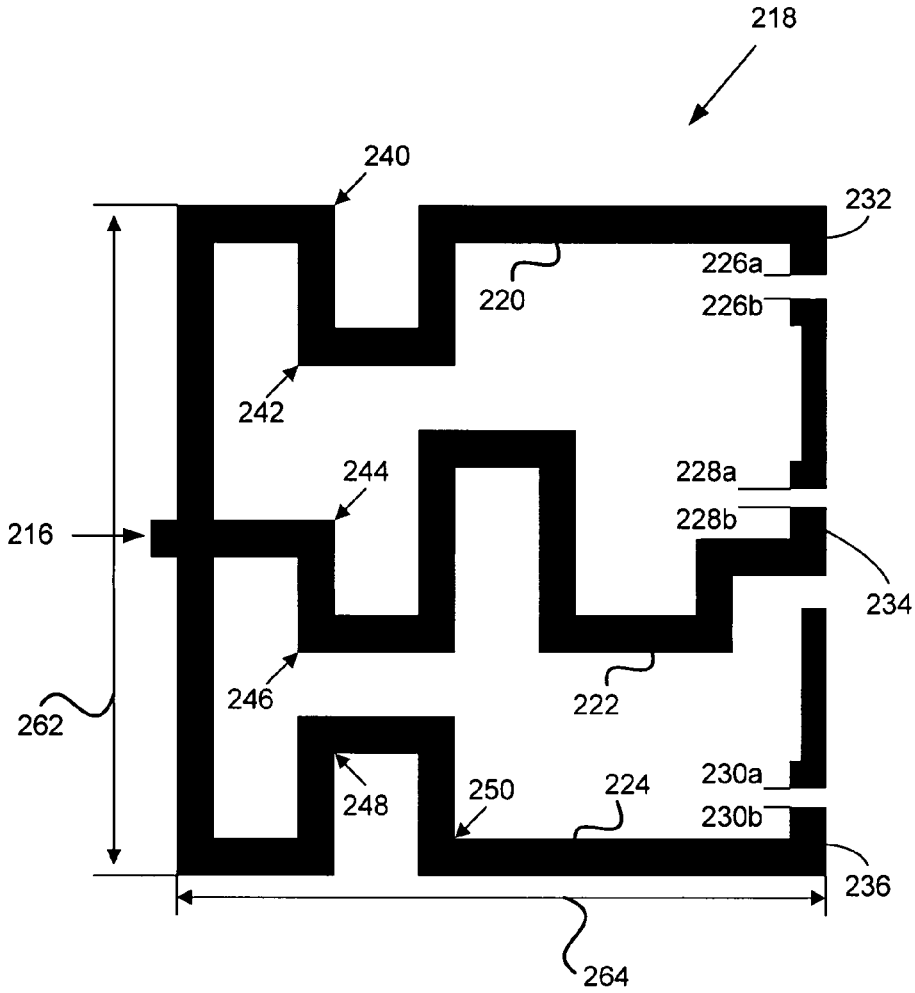
FIG. 2 illustrates the printed element of a three-way splitter according to one embodiment of the present invention.

In FIG. 2, printed element 218 is one exemplary implementation of printed element 118 of three-way splitter 108 of FIG.

1, according to one embodiment of the invention. In printed element 218 in FIG. 2, input 216, and splitter outputs 232, 234, and 236, correspond respectively to input 116, and splitter outputs 132, 134, and 136 in FIG. 1. Moreover, printed element 218 may be used in conjunction with a resistive network comprising discrete resistors (not shown in FIG. 2) connecting output terminals 226*a* with 226*b*, 228*a* with 228*b*, and 230*a* with 230*b* in respective splitter outputs 232, 234, and 236. Although not shown in FIG. 2 to preserve simplicity, a via can be used to provide electrical contact between points 228*a* and 230*a*, thus completing the formation of an exemplary three-way splitter according to the conceptual block diagram of three-way splitter 108 of FIG. 1.

Printed element 218 in FIG. 2 includes printed branches 220, 222, and 224 that were not shown in FIG. 1. Printed branches 220, 222, and 224 route communication signals from input 216 to respective splitter outputs 232, 234, and 236. As shown in FIG. 2, printed branches 220, 222, and 224, may include a number of substantially right angles as indicated, for example, by corners 240 and 242 in first printed branch 220, corners 244 and 246 in second printed branch 222, and corners 248 and 250 in third printed branch 224. According to one embodiment, such as that shown in FIG. 2, printed branches 220 and 224 include at least four substantially ninety-degree angles, while printed branch 222 includes at least eight substantially ninety-degree angles. Inclusion of a number of substantially ninety-degree angles in the first, second, and third printed branches permits printed element 218 to present a compact footprint (i.e. to consume less surface area). In the present embodiment, printed element 218 consumes surface area corresponding to width 262 and length 264. Additionally, the substantially ninety-degree angles in each printed branch cause sufficient "self-coupling" of the electromagnetic field generated by each printed branch with itself, resulting in optimal performance characteristics, such as optimal impedance, insertion loss, and return loss.

Continuing with FIG. 2, in one embodiment, printed branches 220, 222, and 224 may be "quarter wavelength" transmission lines, i.e. may have lengths equal to approximately one quarter of a wavelength in a mid-range of a desired range of frequencies. In a frequency range of approximately 900 MHz to approximately 2.2 GHz, for example, printed branches 220, 222, and 224 may have lengths corresponding to approximately a quarter wavelength at a mid-range frequency of about 1.5 GHz. Although, the length of such quarter wavelength transmission line, e.g. the length of each printed branch 220, 222, and 224, would typically be approximately 1.2 inches, due to the unique ninety-degree angle implementation of printed branches 220, 222, and 224 in the present invention, the overall footprint of printed element 218 will be much smaller, for example width 262 and length 264 can each be approximately 0.75 inches.

The invention's three-way splitter including a printed element, such as printed element 218 in FIG. 2, resolves various problems associated with conventional discrete implementation of three-way splitters. For example, due its implementation on a printed circuit board, the present invention may be used at only a nominal cost associated with discrete resistors 126, 128 and 130, since printed element 218 may be fabricated at virtually no additional cost to a printed circuit board manufacturer since no additional mask or processing step is required to pattern a circuit board to include the printed element of the invention's three-way splitter, such as printed element 218. This is in contrast to the more expensive conventional implementation using only discrete components, which adds cost through both its requirements for individual parts, and for their assembly.

In addition to offering an inexpensive and effective implementation of a three-way splitter, the present invention consumes significantly less surface area than conventional three-way splitters. Conventional three-way splitters relying on only discrete components typically consume, for example, approximately 3.5 square inches of surface area, making that unavailable for other uses. By contrast, according to the exemplary embodiment present invention in FIG. 2, the surface area consumed by printed element 218 is determined by width 216 and length 218, and is approximately 0.5 square inches. As a result of the compact, integrated implementation possible through the invention's three-way splitter, the surface area dedicated to this purpose on a PCB can be about seven times smaller when compared to the surface area consumed by conventional three-way splitters.

In addition to cost and surface area advantages, the present invention results in performance improvements over conventional three-way splitters. For example, in a conventional three-way splitter, insertion loss and return loss result in loss of signal power delivered by the three-way splitter. Across a range of desirable frequencies, for example, from approximately 900 MHz to approximately 2.2 GHz, conventional three-way splitters typically display an insertion loss in excess of 6 dB, and a return loss of approximately 15 dB. Moreover, the insertion loss profile for conventional three-way splitters over this frequency range is not flat and shows marked deterioration away from mid-range frequencies.

Figure 3:
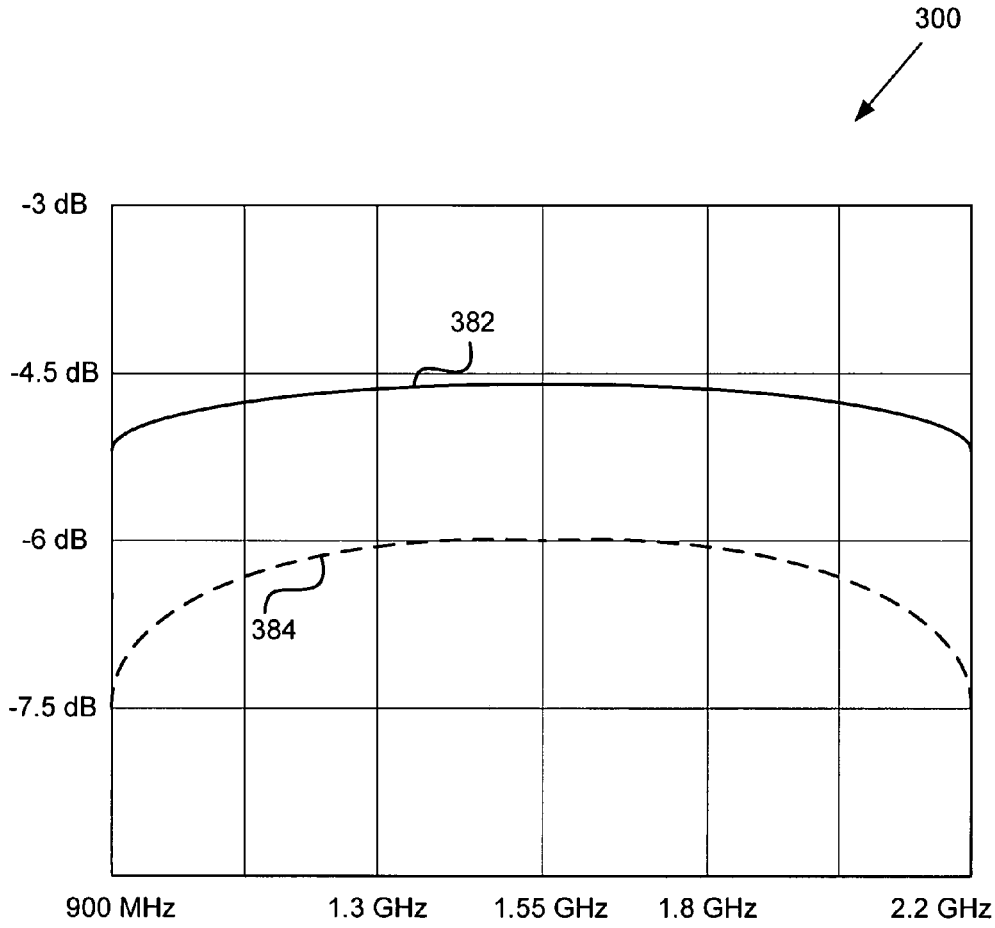
FIG. 3 is a graph comparing three-way splitter insertion losses across an exemplary range of frequencies.

FIG. 3 shows a graph comparing three-way splitter insertion losses across an exemplary range of frequencies. Graph 300 in FIG. 3 displays insertion loss as a function of input frequency from 900 MHz to 2.2 GHz. Insertion loss for each printed branch in a printed element of a three-way splitter according to an embodiment of the present invention are substantially equivalent, and are represented by single curve 382. Curve 384 depicts a typical insertion loss associated with a conventional discrete component-only implementation of a three-way splitter across the same frequency range.

As shown in graph 300 of FIG. 3, insertion loss is improved (indicated by a smaller negative number in dB) and more consistent (i.e. flatter) across the frequency range, in the present invention relative to a conventional three-way splitter. As illustrated by curve 382, at a mid-range frequency of about 1.5 GHz, the present embodiment of the invention's three-way splitter may provide an insertion loss of about 4.5 dB, which is close to a theoretical limit of 4.5 dB for three-way splitters, as is known in the art. At the same mid-range frequency of about 1.5 GHz, a conventional three-way splitter results in an insertion loss of at least 6 dB as shown by curve 384 in graph 300. Even more striking is the contrast in performance at the extremes of the frequency range. While both the invention's and conventional three-way splitters display performances that are somewhat symmetrical about the mid-range, performance for the present invention is flatter than that of the conventional three-way splitter. At the extremes of 900 MHz and 2.2 GHz, for example, the present embodiment of the invention displays an insertion loss of approximately 5 dB, while the conventional three-way splitter shows deterioration in performance to about 7.5 dB. In other words, by having an insertion loss across a range of frequencies that is both smaller and flatter than that achievable by a conventional three-way splitter, the present invention reduces insertion loss by approximately 1 dB to approximately 2.5 dB.

Figure 4:
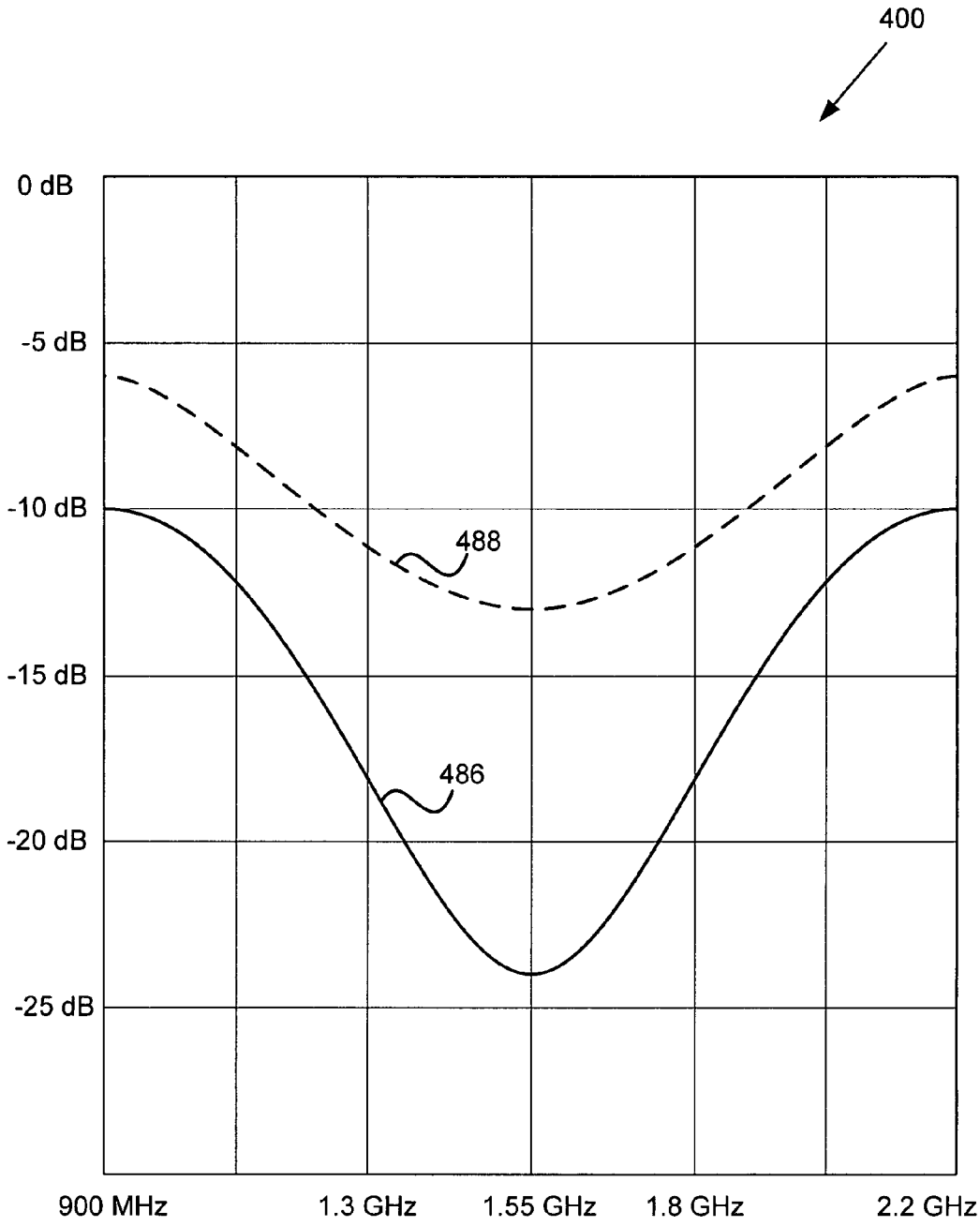
FIG. 4 is a graph comparing three-way splitter return losses across an exemplary range of frequencies.

FIG. 4 shows a graph comparing three-way splitter return losses across an exemplary range of frequencies. Graph 400 in FIG. 4 displays return loss as a function of input frequency from 900 MHz to 2.2 GHz. Return loss for a three-way splitter according to an embodiment of the present invention is represented by curve 486. Curve 488 depicts a typical return loss associated with a conventional discrete component-only implementation of a three-way splitter across the same frequency range.

As shown in FIG. 4, return loss of the present invention's three-way splitter is improved (indicated by a larger negative number in dB) relative to that of the conventional three-way splitter. At a mid-range frequency of about 1.5 GHz, the present embodiment of the invention's three-way splitter may provide a return loss of approximately 24 dB. At the same mid-range frequency of about 1.5 GHz, a conventional three-way splitter has a return loss of approximately 13 dB. While the invention's three-way splitter displays improved performance at the mid-range frequency of about 1.5 GHz, the present invention maintains improved return loss across the entire range of frequencies relative to the return loss of the conventional three-way splitter. At the extremes of 900 MHz and 2.2 GHz, for example, the present embodiment of the invention provides a return loss of approximately 10 dB, while a conventional three-way splitter provides only about 6 dB. In short, the present invention provides a return loss improved by approximately 4 dB at the extreme frequencies of 900 MHz (or 2.2 GHz), to more than 10 dB at the mid-range frequency of about 1.5 GHz.

Figure 5:
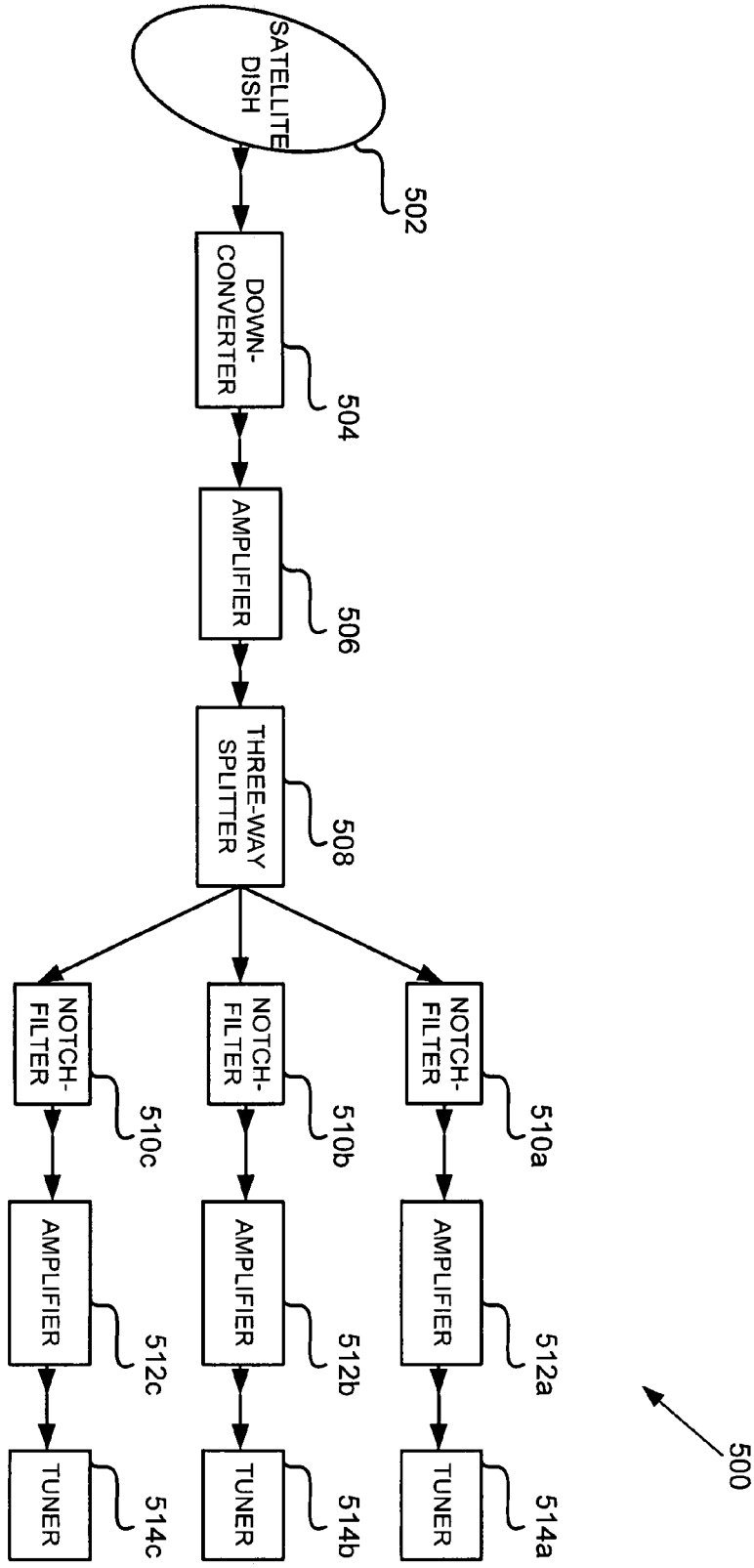
FIG. 5 is a block diagram of an exemplary system utilizing an embodiment of the invention's three-way splitter.

FIG. 5 illustrates a diagram of exemplary electronic system 500 utilizing an embodiment of the invention's three-way splitter, for example, three-way splitter 108 including printed element 218, described above. Electronic system 500 can be a satellite receiving system, for example. Electronic system 500 includes satellite dish 502, down-converter 504, amplifier 506, three-way splitter 508, notch-filters 510*a*, 510*b*, and 510*c*, amplifiers 512*a*, 512*b*, and 512*c*, and tuners 514*a*, 514*b*, and 514*c*. Three-way splitter 508 of system 500 can be, for example, printed three-way splitter 108 of FIG. 1, including printed element 218 of FIG. 2, as described above. Electronic system 500 may contain additional electronic components not shown in FIG. 5 or described herein.

Satellite dish 502 typically receives relatively high radio frequencies. Down-converter 504 converts the signals received by satellite dish 502 to much lower frequencies. Down-converter 504 can include a low noise amplifier ("LNA") and a low noise block ("LNB") down-converter, for example. Down-converter 504 can be connected to amplifier 506. Three-way splitter 508 may be connected between amplifier 506 and notch-filters 510*a*, 510*b*, and 510*c*. As described above, three-way splitter 508 can provide output signals having substantially the same phase, frequency, and impedance to notch filters 510*a*, 510*b*, and 510*c*. Since three-way splitter 508 distributes a signal received by a satellite dish to notch-filters 510*a*, 510*b*, and 510*c*, for frequency selection and further amplification and tuning, reductions in loss of power of the received signal, as well as improvements in implementation associated with reduced cost and area consumption advantageously improve the sensitivity and performance of electronic system 500.

Thus, embodiments of the present invention's three-way splitter, one of which was specifically described above, result in a significantly improved three-way splitter to distribute an input signal having a certain frequency, for example in a range from 900 MHz to 2.2 GHz, while overcoming various disadvantages of conventional three-way splitters. For example, various embodiments of the invention are cost effective and require a relatively small amount of PCB surface area to implement. Moreover, unlike the conventional three-way splitters, various embodiments of the invention's three-way splitter provide improvements in both insertion and return losses across a range of frequencies (for example from 900 MHz to 2.2 GHz). The invention's three-way splitter can thus be effectively utilized to, for example, improve the efficiency of signal distribution in satellite receiving systems and other electronic systems, without various shortcomings of the conventional three-way splitters.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. The described embodiments are to be considered in all respects as illustrative and not restrictive. It should also be understood that the invention is not limited to the particular embodiments described herein, but is capable of many rearrangements, modifications, and substitutions without departing from the scope of the invention.

Thus, a three-way splitter including a printed element has been described.

The invention claimed is:

1. A three-way splitter for distribution of a communication signal having a frequency greater than approximately 900 MHz, said three-way splitter comprising:

a printed element comprising three printed branches on a printed circuit board;

three splitter outputs being inter-coupled by a resistive network;

said printed element receiving said communication signal, and routing said communication signal to each of said three splitter outputs through said three printed branches so as to cause said three splitter outputs to have substantially a same output frequency, phase, and impedance;

said three-way splitter having an insertion loss of better than 5 dB.

2. The three-way splitter of claim 1 wherein said communication signal is in a range from approximately 900 MHz to approximately 2.2 GHz.

3. The three-way splitter of claim 1 wherein said three printed branches are quarter wavelength transmission lines.

4. The three-way splitter of claim 1 wherein said three printed branches are quarter wavelength transmission lines at a frequency of approximately 1.5 GHz.

5. The three-way splitter of claim 1 wherein said printed element occupies less than 1.0 square inch of surface area on said printed circuit board.

6. The three-way splitter of claim 1 having a return loss of better than 10 dB.

7. A satellite receiving system including the three-way splitter of claim 1.

8. A satellite receiving system including a three-way splitter for distribution of a communication signal having a frequency greater than approximately 900 MHz, said three-way splitter comprising:

a printed element comprising three printed branches on a printed circuit board;

three splitter outputs being inter-coupled by a resistive network;

said printed element receiving said communication signal, and routing said communication signal to each of said three splitter outputs through said three printed branches so as to cause said three splitter outputs to have substantially a same output frequency, phase, and impedance;

said three-way splitter having an insertion loss of better than 5 dB.

9. The satellite receiving system of claim 8 wherein said communication signal is in a range from approximately 900 MHz to approximately 2.2 GHz.

10. The satellite receiving system of claim 8 wherein said three printed branches are quarter wavelength transmission lines.

11. The satellite receiving system of claim 8 wherein said three printed branches are quarter wavelength transmission lines at a frequency of approximately 1.5 GHz.

12. The satellite receiving system of claim 8 wherein said printed element occupies less than 1.0 square inch of surface area on said printed circuit board.

13. The satellite receiving system of claim 8 having a return loss of better than 10 dB.

14. A three-way splitter for distribution of a communication signal in a frequency greater than approximately 900 MHz, said three-way splitter including a printed element on a printed circuit board, said printed element comprising:

a first printed branch having at least four substantially ninety-degree angles and a first output;

a second printed branch sharing an input with said first printed branch and having at least eight substantially ninety-degree angles and a second output;

a third printed branch sharing said input with said first and second printed branches and having at least four substantially ninety-degree angles and a third output;

wherein said first, second, and third printed branches cause said first, second and third outputs to have substantially a same output frequency, phase, and impedance.

15. The three-way splitter of claim 14 wherein said first, second and third outputs of said printed element are intercoupled by a resistive network.

16. The three-way splitter of claim 14 wherein said communication signal is in a range from approximately 900 MHz to approximately 2.2 GHz.

17. The three-way splitter of claim 14 wherein said printed element occupies less than 1.0 square inch of surface area on said printed circuit board.

18. A satellite receiving system including the three-way splitter of claim 14.

* * * * *